US006533606B2

(12) United States Patent
Yamane

(10) Patent No.: US 6,533,606 B2
(45) Date of Patent: Mar. 18, 2003

(54) ELECTRICAL CONNECTOR

(75) Inventor: Hiroshi Yamane, Yokohama (JP)

(73) Assignee: J. S. T. Mfg. Co. Ltd., Osaka (JP)

( * ) Notice: Subject to any disclaimer, the term of this patent is extended or adjusted under 35 U.S.C. 154(b) by 0 days.

(21) Appl. No.: 10/078,513

(22) Filed: Feb. 21, 2002

(65) Prior Publication Data

US 2002/0115340 A1 Aug. 22, 2002

(30) Foreign Application Priority Data

Feb. 22, 2001 (JP) ..... 2001-046884

(51) Int. Cl.[7] ..... H01R 12/24
(52) U.S. Cl. ..... 439/495; 439/260
(58) Field of Search ..... 439/495, 496, 439/260

(56) References Cited

U.S. PATENT DOCUMENTS 5,194,017 A * 3/1993 Consoli ..... 439/492
5,312,267 A * 5/1994 Matsuoka et al. ..... 439/331
5,474,468 A * 12/1995 Chishima et al. ..... 439/495
6,056,572 A * 5/2000 Matsumoto et al. ..... 439/495
6,089,905 A * 7/2000 Shimmyo et al. ..... 439/495
6,224,418 B1 * 5/2001 Miura et al. ..... 439/495
6,338,648 B1 * 1/2002 Miura et al. ..... 439/495
6,345,998 B1 * 2/2002 Lee ..... 439/495

FOREIGN PATENT DOCUMENTS

JP 08-031526 2/1996
JP 11-016643 1/1999

* cited by examiner

*Primary Examiner*—Renee Luebke
*Assistant Examiner*—Briggitte Hammond
(74) *Attorney, Agent, or Firm*—Rader, Fishman & Gauer PLLC

(57) ABSTRACT

An electrical connector for connection of a flat-type connection member is disclosed. The electrical connector includes a cover pivotally moved to open or close an opening of a housing. The cover is reinforced with a metal plate. The cover includes a pair of support shafts for pivotal movement, and engagement portions adapted to engage with lock portions of the housing for locking the cover in a close position. The metal plate is provided with the pair of support shafts and the pair of engagement portions.

10 Claims, 9 Drawing Sheets

ELECTRICAL CONNECTOR

CROSS REFERENCE TO RELATED APPLICATION

This application claims the benefit under 35 U.S.C. §119 of Japanese Patent Application No. 2001-46884, the abstract of disclosure of which is incorporated herein by reference.

BACKGROUND OF THE INVENTION

1. Field of the Invention

The present invention relates to an electrical connector used for connection of a flat-type connection member for a flexible flat cable generally called FPC (Flexible Printed Circuit), PCB (Printed Circuit Board) and the like.

2. Description of Related Arts

As the connector of this type, there has conventionally been known one which includes a synthetic-resin housing having an opening; contacts arranged in a manner to face into the opening of the housing; and a synthetic-resin cover adapted to be pivotally moved for opening or closing the opening of the housing.

It is preferred in this case that an insert force is not required for inserting a flat connection member in the opening while the cover is opened (a so-called ZIF: Zero Insert Force configuration) and that when the cover is closed, a pressure portion of the cover presses contact portions of the contacts against the connection member).

More recently, there has been a strong demand for decreasing the height of the connector (slim design). This leads to a demand for decreasing the thickness of the cover. In the applications of cellular phones, DVD and the like, for instance, there is a demand for a connector of slim design which has a height of, say, not more than 1 mm.

If the cover is decreased in thickness in order to implement the slim design of the connector, the cover in a close position will be deflected so as to be decreased in the force for pressing the connection member against the contact portions of the contacts. This may result in conduction failure.

In view of the foregoing problem, the invention has been accomplished, having an object to provide an electrical connector accomplishing the slim design and ensuring positive continuity with the connection member by preventing the cover from being deflected.

SUMMARY OF THE INVENTION

In accordance with a preferred embodiment of the invention for achieving the above object, an electrical connector for connection of a flat-type connection member comprises: an insulative housing having an opening and a plurality of contacts facing into the opening; a synthetic-resin cover pivotally movable about a predetermined pivotal axis for moving between an open position and a close position to press the connection member against the contacts; a pair of support shafts disposed at a pair of sides of the cover, respectively, and extended along the pivotal axis; a pair of engagement portions disposed at a pair of sides of the cover; a pair of support portions disposed at the housing for supporting the pair of support shafts, respectively; a pair of lock portions disposed at the housing and disengageably engaging the pair of engagement portions for locking the cover in the close position; and a metal plate for reinforcing the cover as retained by the cover; wherein the metal plate is provided with the pair of support shafts and the pair of engagement portions.

According to the embodiment, the cover is reinforced with the metal plate whereas the metal plate is integrally formed with the support shafts and the locking engagement portions. Therefore, the whole body of the cover in the close position can achieve a high deflection strength even if the cover is decreased in thickness for the purpose of the slim design. As a result, a high contact pressure against the connection member is ensured, thus resulting in the assured conduction.

The support shafts and the engagement portions, in particular, are formed integrally with the metal plate and hence, the inventive connector is decreased in the number of components. This leads to an easy fabrication of the connector as well as to the reduction of fabrication costs.

DETAILED DESCRIPTION OF THE PREFERRED EMBODIMENT

A preferred embodiment of the invention will be described with reference to the accompanying drawings.

Figure 1:
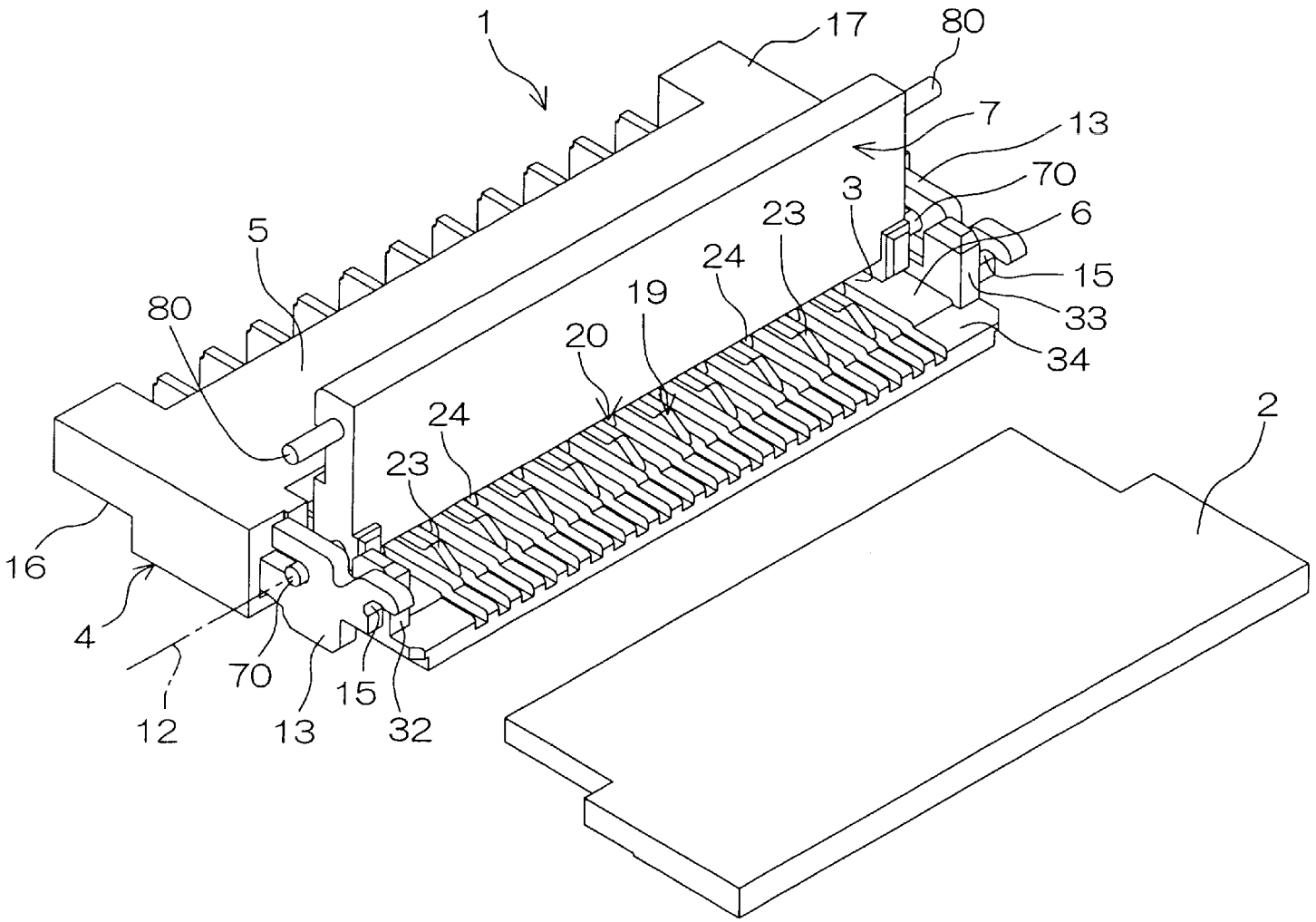
FIG. 1 is a disassembled perspective view showing an electrical connector according to one embodiment of the invention and a connection member.
Figure 2:
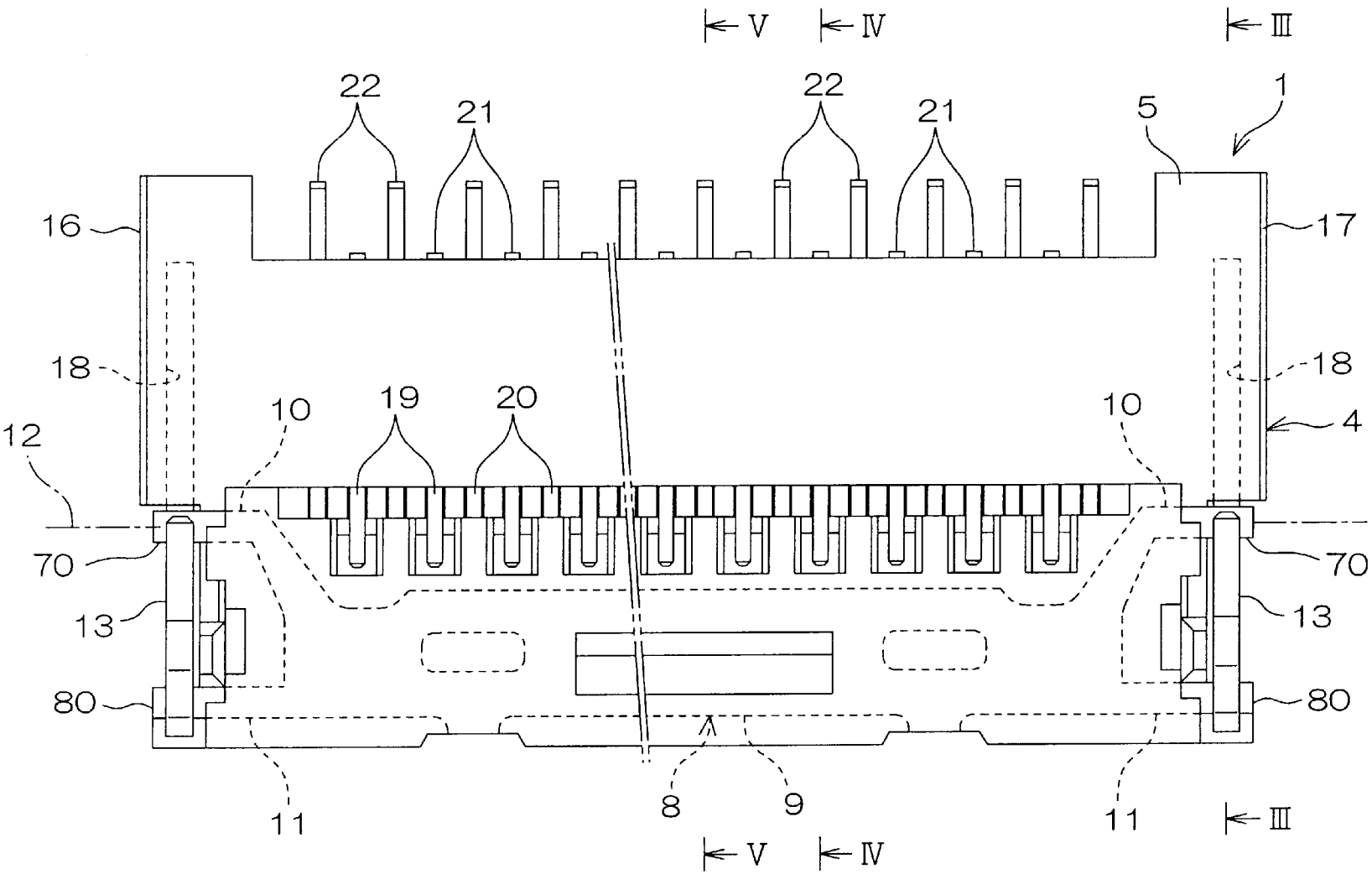
FIG. 2 is a partially cut-away plan view showing the electrical connector with a cover closed.

Now referring to FIGS. 1 and 2, an electrical connector 1 according to one embodiment of the invention comprises a housing 4 formed from an insulative synthetic resin material and defining an insertion space 3 in which a connection member 2 for FPC (Flexible Printed Circuit) or the like is removably inserted from a front side thereof. A fore half part of the housing 4 is open upward via an opening 6 of an upper plate section 5 of the housing 4. The housing 4 is pivotally provided with a cover 7 which is formed from an insulative synthetic resin material and pivotally moved to open or close the opening 6.

The cover is reinforced with a flat metal plate 8 such as formed of a sheet metal. The metal plate 8 includes a body portion 9 to be embedded in the cover 7 in the forming process thereof. The body portion 9 is in the form of a transversely elongated rectangle. The body portion is formed with a pair of angle-shaped projections 10 extended from opposite sides of its rear edge in diagonally rearward directions and then in transverse directions, and is also formed with a pair of projections 11 extended from opposite sides of its front edge in transverse directions. Distal ends of the former pair of projections 10 are exposed from transversely opposite sides of the cover 7, defining a pair of pivotal shafts 70 extended along a pivotal axis 12 of the cover 7. The pivotal shafts 70 are each supported by a guiding support portion 14 as allowed to pivot and slide back and forth, the guiding support portion formed at a metallic reinforcement plate 13 fixed to the housing 4.

On the other hand, the latter pair of projections 11 are also exposed from the transversely opposite sides of the cover 7, defining a pair of locking engagement portions 80. The engagement portions 80 are engaged with corresponding lock portions 15 formed at the respective reinforcement plates 13 (hereinafter, also referred to as "reinforcement tabs 13") thereby locking the cover 7 in a close position.

The metal plate 8 is formed of a sheet metal material whereas the projections 10, 11 are formed into a circular shape in section in the sheet metal working process. Thus, the pivotal shafts 70 and engagement portions 80 also have a circular shape in section so as to smoothly slide on the guiding support portions 14 and the lock portions 15. Opposite side plates 16, 17 of the housing 4 define lateral sides of the insertion space 3. Fixing holes 18, in paired relation, open into respective front end faces of the side plates 16, 17 (not shown in FIG. 1 but illustrated in FIG. 2 and FIG. 3 which is a sectional view taken on the line III—III in FIG. 2). The fixing holes 18 receive the reinforcement plates 13 from front sides thereof for fixing the plates 13.

In the housing 4, a plurality of first and second contacts 19, 20 are retained in the insertion space 3 in a manner to face into the opening 5. The first and second contacts 19, 20 are press-inserted from the rear side of the housing 4 into corresponding fixing holes to be fixed therein (see FIGS. 4 and 5). The contacts are arranged in two rows in zigzag configuration as alternately shifted forwardly and rearwardly relative to each other.

More specifically, as shown in FIG. 2, lead portions 19, 20 of the first and second contacts 19, 20 are exposed rearwardly of the housing 4 and arranged in a zigzag fashion as alternately shifted forwardly and rearwardly relative to each other. The lead portion 21 of the first contact 19 is located forwardly relative to the lead portion 22 of the second contact 20. By virtue of the zigzag arrangement of the lead portions 21, 22, the contacts 19, 20 can be arranged at a decreased pitch without a fear of interference between spaces for soldering the lead portions 21, 22 to corresponding conductive portions of the board. Thus, the packaging density can be increased.

Similarly, as shown in FIG. 1, contact portions 23, 24 of the first and second contacts 19, 20 to be connected with the connection member 2 are also arranged in a zigzag fashion as alternately shifted forwardly and rearwardly relative to each other. The contact portion 23 of the first contact 19 to be connected with the connection member 2 is located forwardly relative to the contact portion 24 of the second contact 20 to be connected with the connection member 2.

The inventive electrical connector is configured as a so-called W-ZIF (Double Zero Insert Force) type connector wherein after inserted into the insertion space 3 with zero insert force, the connection member 2 is pressed against the contact portions 23, 24 of the first and second contacts 19, 20 for ensuring contact pressure.

Figure 3:
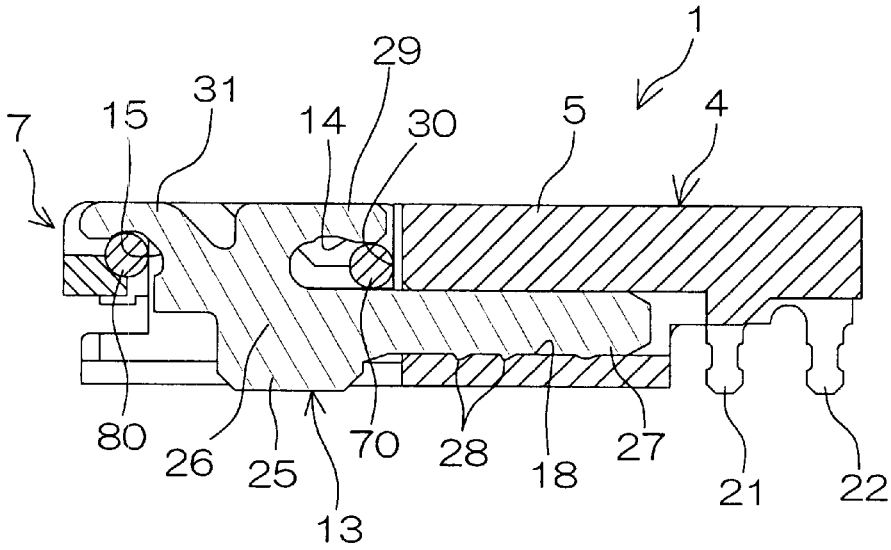
FIG. 3 is a sectional view taken on the line III—III in FIG. 2.

Referring to FIG. 3, the reinforcement tab 13 includes a body portion 26 defining a fixing portion 25, the guiding support portion 14 and the lock portion 15; and an insertion portion 27 extended rearwardly of the body portion 26. The fixing portion 25 is formed at a lower edge of the body portion 26 and soldered to a surface of the board. The insertion portion 27 is inserted from the front side into the fixing hole 18 and fixed therein via locking projections 28.

The guiding support portion 14 comprises an angle-shaped extension piece 29 extended upwardly from a front end of the body portion 26, and a recessed groove defined between the body portion 26 and a position restriction portion 30 of the housing 4. The guiding support portion 14 supports a corresponding pivotal shaft 70 in a manner to allow for a slidable movement of the shaft between a forward position shown in FIG. 10A and a rearward position shown in FIGS. 3 and 10B, as well as for a pivotal movement thereof. The position restriction portion 30 serves as a stopper for positioning the pivotal shaft 70 at the rearward position.

The lock portion 15 is defined by a bent extension piece 31 extended upwardly and forwardly from the front end of the body portion 26. The lock portion 15 is shaped like a recessed groove. When the cover 7, having been closed, is slidably moved rearwardly (that is, when the pivotal shaft 70 is shifted to the rearward position), the lock portion 15 comes into engagement with the engagement portion 80, as shown in FIG. 10B, thereby locking the cover 7 in the close position.

Returning to FIGS. 1 and 2, guide walls 32, 33 upstand from opposite lateral edges of a front portion of a lower plate section 34 of the housing 4. The guide walls 32, 33 engage with lateral edges of the cover 7 for restricting a transverse movement of the cover 7.

Figure 4:
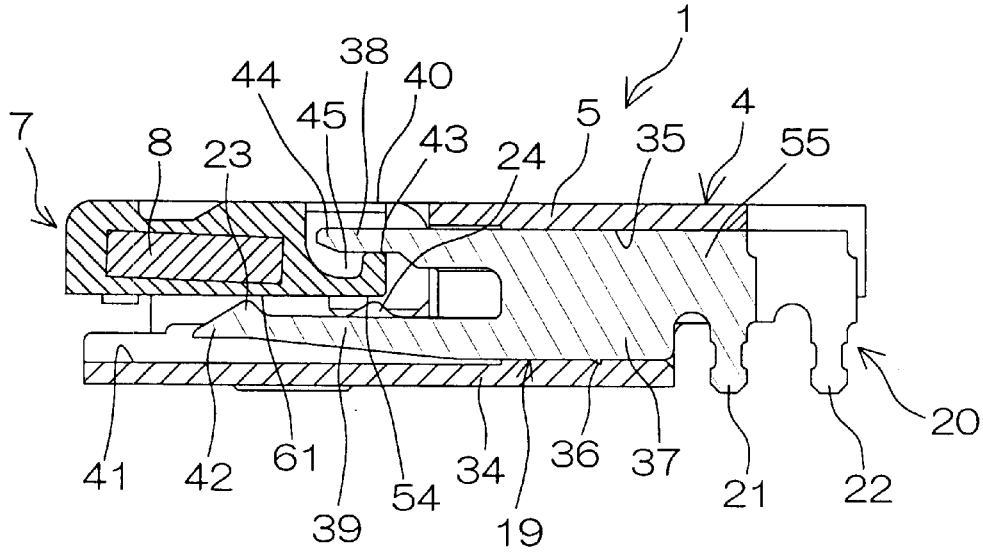
FIG. 4 is a sectional view taken on the line IV—IV in FIG. 2.

Referring to FIG. 4 which is a sectional view taken on the line IV—IV in FIG. 2, the first contact 19 comprises a metal member and is inserted from the rear side into the insertion space 3 of the housing 4 to be fixed to place. As shown in FIG. 4, the first contact includes a body portion 37 with locking projections 36 which is fixed in a fixing hole 35 of the housing 4; a fixing piece 38 and a resilient piece 39 which are extended forwardly of the body portion 37; and the aforesaid lead portion 21 extended rearwardly of the body portion 37.

A front end 44 of the fixing piece 38 is exposed forwardly from the upper plate section 5 of the housing 4 and extended to place over a guide portion 43 of the cover 7 in the close position, the guide portion 43 defined by a groove formed by carving a rear edge portion 40 of the cover 7. In FIG. 4, a reference numeral 45 indicates a recess adjoining the guide portion 43 of the cover 7. The recess 45 is provided in order to avoid interference with the front end 44 of the fixing piece 38 when the cover 7 is pivotally or slidably moved. A back side of the guide portion 43 defines a pressure portion 54. When the cover 7 is closed and slidably moved rearwardly, the pressure portion 54 is positioned above the contact portion 24 of the second contact 20 so as to press the connection member 2 against the contact portion 24 of the second contact 20 in a state where the guide portion 43 is received by the fixing piece 38. The guide portion 43 also includes a pressure portion 61 defined by a portion located to confront the contact portion 23 of the first contact 19 when the cover in the close position is slidably moved rearwardly, thereby pressing the connection member 2 against the contact portion 23 of the first contact 19.

Returning to FIG. 4, the resilient piece 39 is inserted from the rear side into a receiving groove 41 formed on a top surface of the lower plate section 34 of the housing 4. The body portion 37 supports rear ends of the fixing piece 38 and of the resilient piece 39 in a cantilever fashion. The lead portion 21 is extended downward from a rear end of an extension 55 extended rearwardly from the body portion 37. A front end 42 of the resilient piece 39 is formed with the contact portion 23 defined by an upward angle-like projection for providing contact pressure against the connection member 2.

Figure 5:
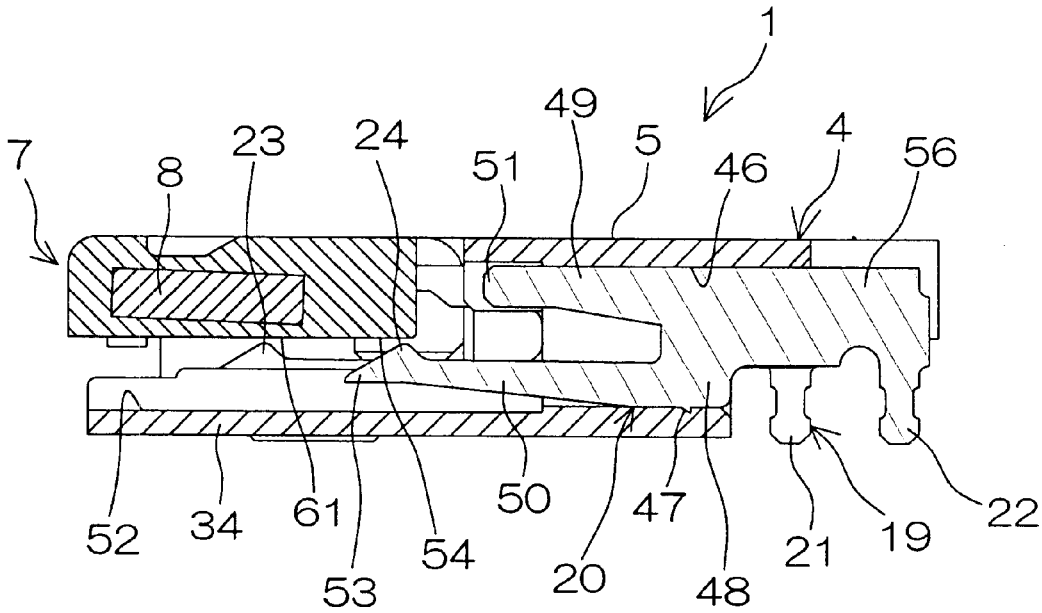
FIG. 5 is a sectional view taken on the line V—V in FIG. 2.

Next, referring to FIG. 5 which is a sectional view taken on the line V—V in FIG. 2, the second contact 20 comprises a metal member which is inserted from the rear side into the insertion space of the housing 4 and fixed to place. The second contact 20 substantially has the same configuration as that of the first contact 19 but differs therefrom in that the second contact is generally disposed rearwardly relative to the first contact 19.

Specifically, the second contact 20 includes a body portion 48 with locking projections 47 which is fixed in a fixing hole 46 of the housing 4; a fixing piece 49 and a resilient piece 50 which are extended forwardly from the body portion 48; and the aforesaid lead portion 22 extended rearwardly from the body portion 48.

A front end 51 of the fixing piece 49 is not exposed forwardly of the upper plate section 5 of the housing 4. In this respect, the second contact 20 differs from the first contact 19.

The resilient piece 50 is inserted from the rear side into a receiving groove 52 formed on the top surface of the lower plate section 34 of the housing 4. The body portion 48 supports rear ends of the fixing piece 49 and of the resilient piece 50 in a cantilever fashion. The lead portion 22 is extended downward from a rear end of an extension 56 extended rearwardly from the body portion 48. A front end 53 of the resilient piece 50 is formed with the contact portion 24 defined by an upward angle-like projection for providing contact pressure against the connection member 2.

Referring to FIGS. 4 and 5, the lead portion 22 of the second contact 20 is located rearwardly relative to the lead portion 21 of the first contact 19 whereas the contact portion 24 of the second contact 20 is located rearwardly relative to the contact portion 23 of the first contact 19.

Figure 6:
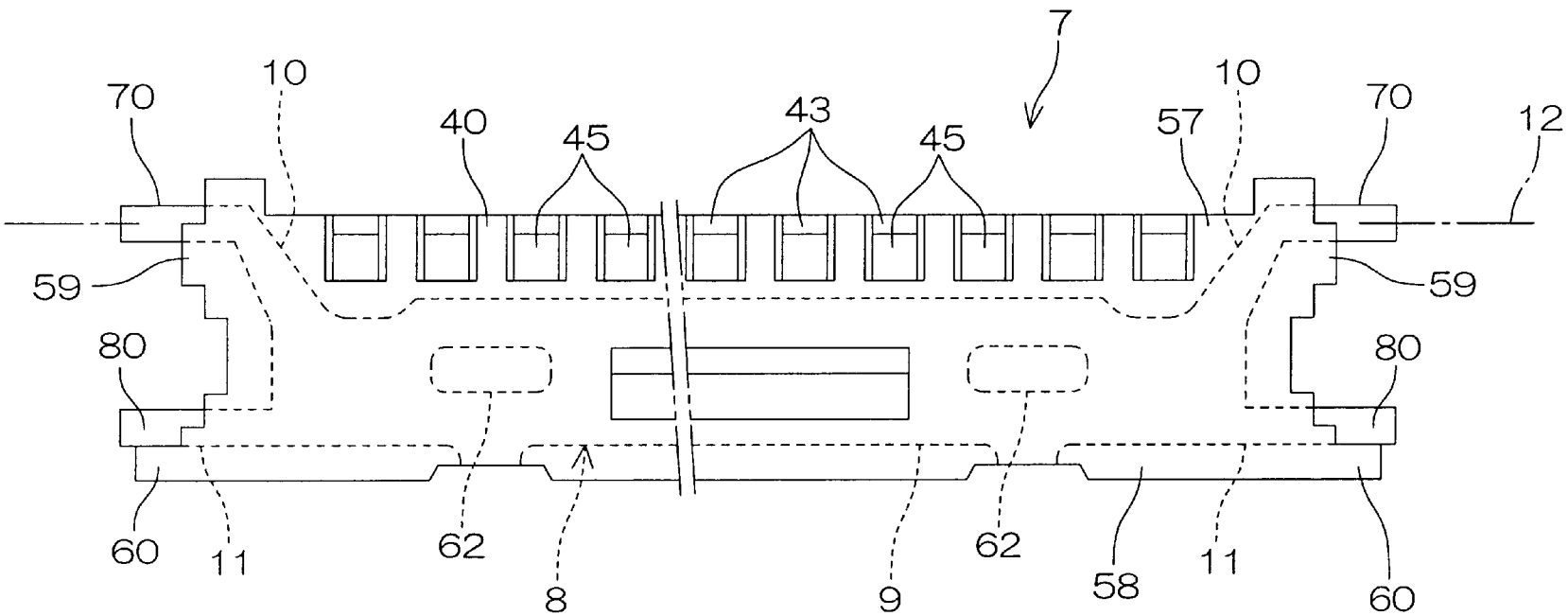
FIG. 6 is a partially cut-away plan view showing the cover.
Figure 7:
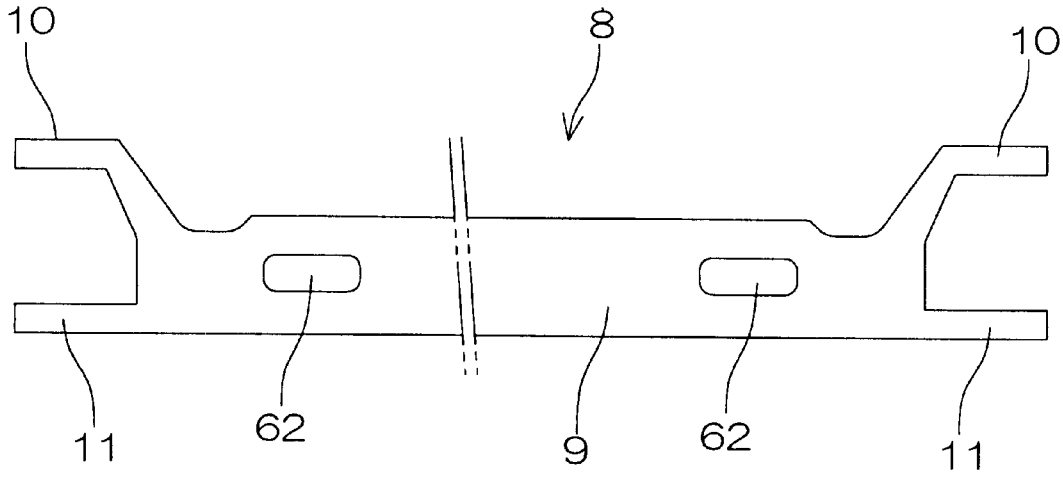
FIG. 7 is a partially cut-away plan view showing a metal plate partially embedded in the cover.

Referring to FIGS. 2 and 6 showing the cover in plan, the cover 7 is in the form of a substantially rectangular plate having a first and a second end 57, 58 in opposed relation. The aforesaid pair of pivotal shafts 70 project from transversely opposite sides 59, 59 of the first end 57 of the cover 7, respectively. On the other hand, the aforesaid pair of engagement portions 80 are exposed from transversely opposite sides 60 of the second end 58 of the cover 7, respectively. As mentioned supra, the pivotal shafts 70 and engagement portions 80 are each formed by a part of individual projections 10, 11 of the metal plate 8 formed of a sheet metal, a most part of which is embedded in the cover 7 in the resin forming process (see FIG. 7). Indicated at 62 are apertures which are formed pairwise, for example, and disposed at transversely spaced places of the body portion 9.

Next, the closing operation and locking operation of the cover 7 will be described with reference to FIGS. 8A–8B and 9A–9B.

Figure 8A:
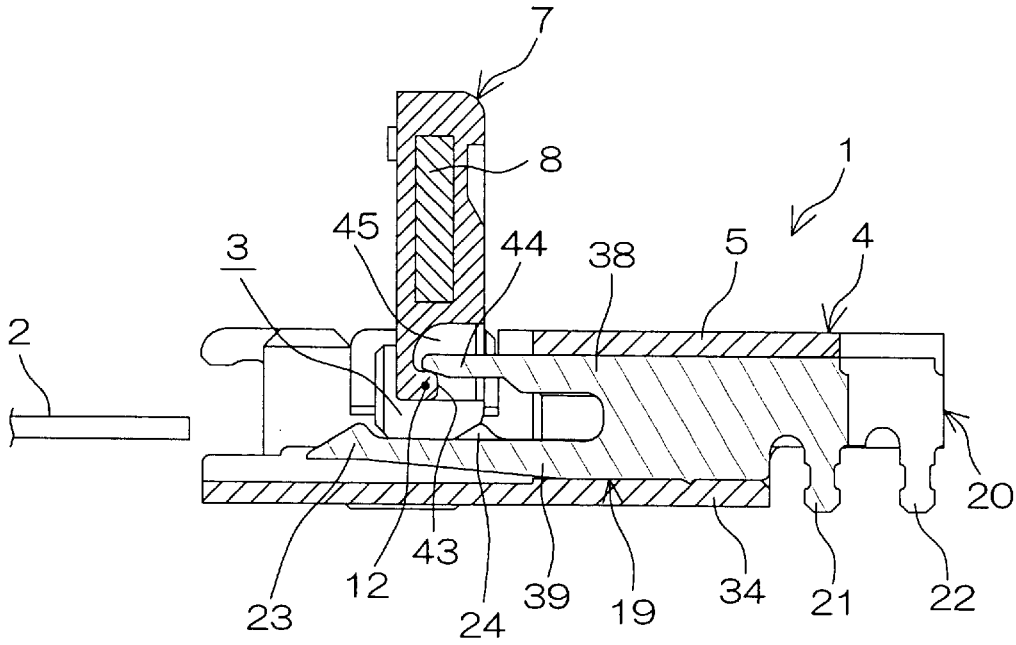
FIGS. 8A and 8B are sectional views showing the electrical connector in correspondence with FIG. 5, FIG. 8A showing a state where the cover is opened whereas FIG. 8B showing a process of closing the cover.
Figure 10A:
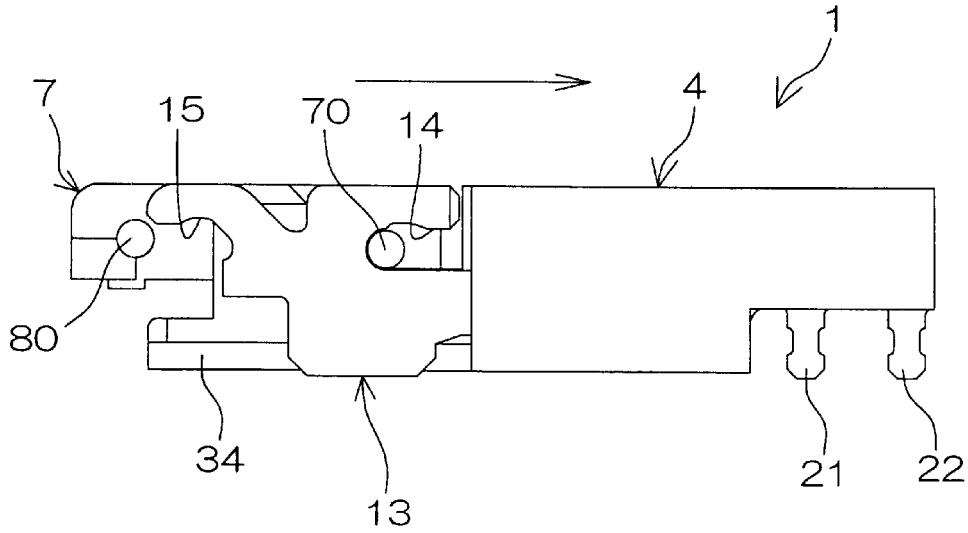
FIGS. 10A and 10B are schematic side views of the electrical connector, FIG. 10A showing a state where the cover is closed with a pivotal shaft located at a forward position whereas FIG. 10B showing a state where the closed cover is slidably moved rearwardly along with the pivotal shaft.
Figure 10B:
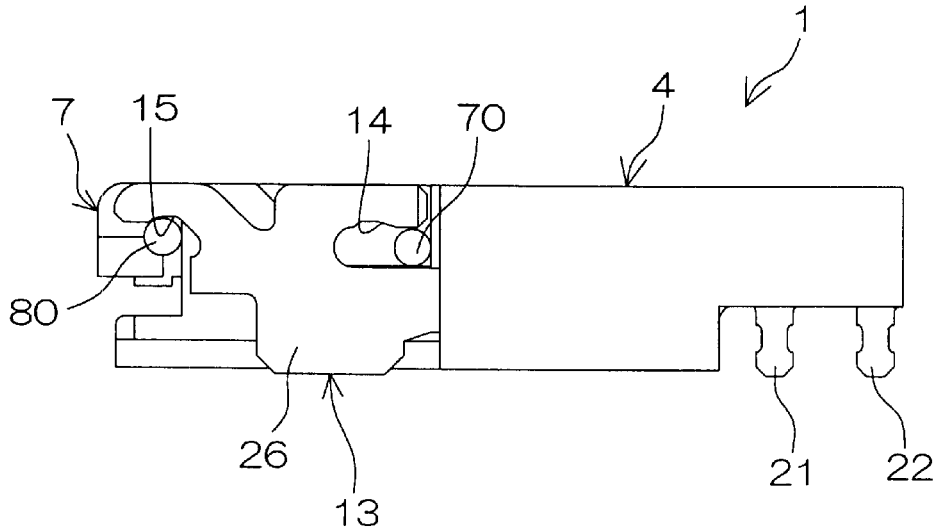

When the cover 7 is in an open position shown in FIG. 8A with the pivotal shaft 70 located at the forward position shown in FIG. 10A, provided above the contact portions 23, 24 of the contacts 19, 20 is the insertion space 3 of a sufficient height which is equal to or greater than a thickness of the connection member 2. Hence, the connection member 2 can be inserted with zero insert force.

Figure 8B:
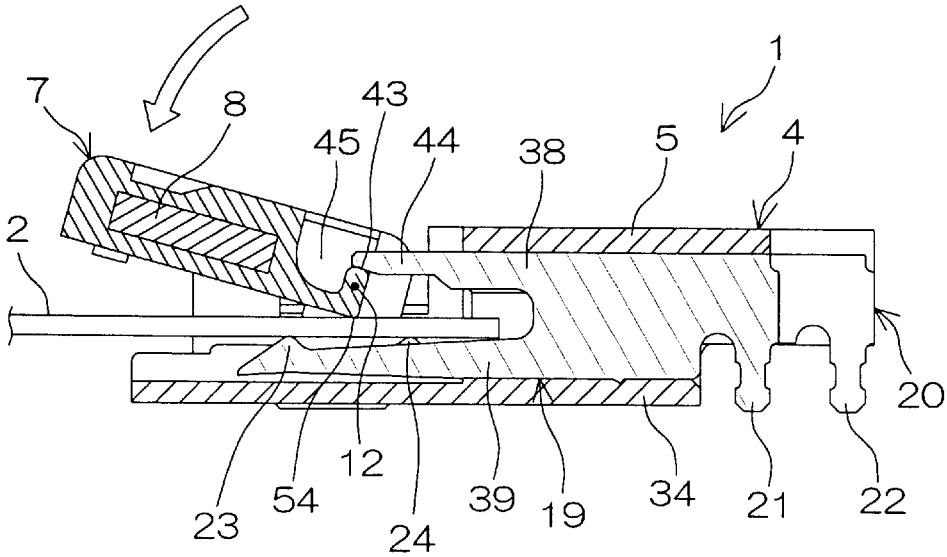
Figure 9A:
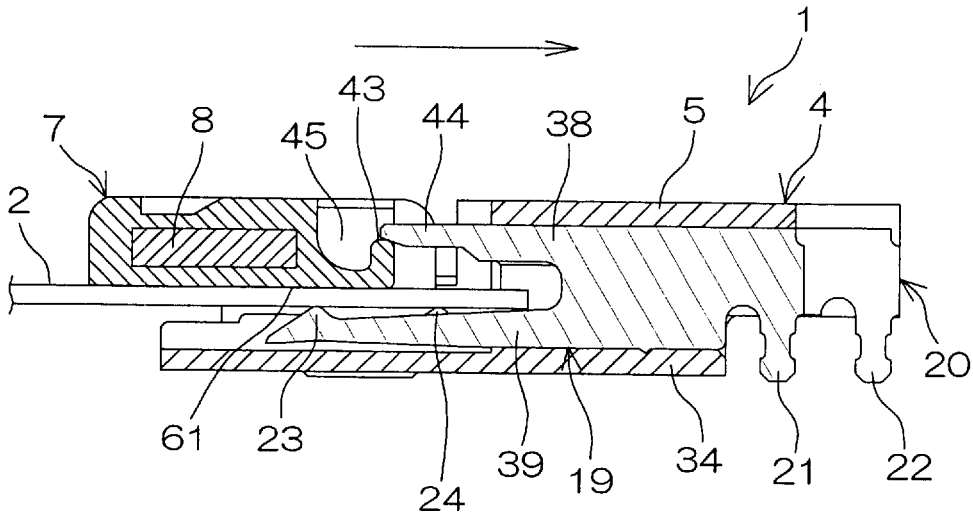
FIGS. 9A and 9B are sectional views showing the electrical connector in correspondence with FIG. 5, FIG. 9A showing a state where the cover is closed whereas FIG. 9B showing a state where the closed cover is slidably moved rearwardly.

After the insertion of the connection member 2, the cover 7 with the pivotal shaft 70 at the forward position is pivoted about the pivotal axis 12, thereby assuming a position shown in FIG. 8B and then a parallel position with respect to the lower plate section 34, as shown in FIG. 9A. This permits the pressure portion 61 of the cover 7 to press the connection member 2 against the contact portion 23 of the first contact 19. However, the connection member 2 is yet to be pushed toward the contact portion 24 at a part thereof on the contact portion 24 of the second contact 20.

Figure 9B:
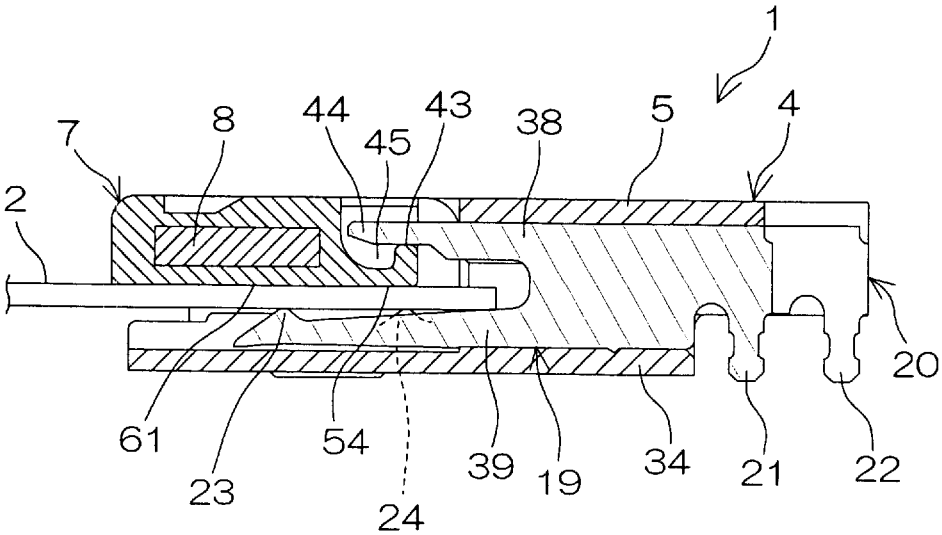

Subsequently, when the cover 7 is slidably moved rearwardly as shown in FIG. 9B, the pressure portion 54 of the cover 7 presses the connection member 2 against the contact portion 24 of the second contact 20. At the same time, the engagement portion 80 is slidably moved along a lower side of the extension piece 31, as shown in FIG. 10B, so as to come into full engagement with the lock portion 15. Thus, the cover 7 is assuredly locked in the close position.

According to the embodiment of the invention, the cover 7 is reinforced with the metal plate 8, while the metal plate 8, the pivotal shafts 70 and the locking engagement portions 80 are formed of sheet metal in one piece. Therefore, the whole body of the cover 7 in the close position can achieve a high deflection strength even if it is decreased thickness for the purpose of the slim design. As a result, a high contact pressure against the connection member 2 is ensured, thus resulting in the assured conduction.

Particularly, since the pivotal shafts 70 and the engagement portions 80 are formed integrally with the metal plate 8 by sheet metal working, the connector is decreased in the number of components. This leads to an easy fabrication of the connector as well as to the reduction of fabrication costs.

Since the body portion 9 of the metal plate 8 is embedded in the cover 7 in the resin forming process thereof, adhesion between the cover 7 and the body portion 9 of the metal plate 8 is increased. This also contributes to the high strength of the whole body of the cover 7. Furthermore, a piece of sheet metal only need be placed in a mold during the resin forming process of the cover 7 so that the sheet metal material is less liable to be dislocated during the resin forming process. This facilitates the fabrication of the cover reinforced with the metal plate.

The projection 10 constituting the pivotal shaft 70 is in a circular shape in section such as to provide for smooth pivotal or slidable movement. The projection 11 constituting the engagement portion 80 is in a circular shape in section such as to smoothly engage with the lock portion 15.

The pivotal shaft 70 of the cover 7 is supported by the guiding support portion 14 of the metallic reinforcement plate 13 and hence, the pivotal shaft is supported in an assured manner. This also ensures that the cover 7 in the close position is positively prevented from being deformed. In addition, the engagement portion 80 of the cover 7 is engaged with the lock portion 15 of the metallic reinforcement plate 13, thus contributing to an even more positive prevention of the deformation of the cover 7 in the close position.

After the cover 7 is closed by a so-called flip-flop system, the cover 7 is slidably moved rearwardly by a predetermined stroke thereby bringing the engagement portion 80 thereof into deep engagement with the lock portion 15 for assuredly locking the cover 7 in the close position. As combined results of the engagement between the engagement portion and the lock portion, and the substantial reinforcement of the cover 7 with the metal plate 8, a high contact pressure against the connection member 2 is ensured.

Particularly in the so-called W-Z IF type connector, both the first and second contacts 19, 20 are press-inserted from the rear side of the housing 4 and have their body portions 37, 48 with the locking projections 36, 47 rigidly secured to the housing 4. Therefore, the connection member 2 can be firmly clamped between the resilient pieces 39, 50 and the pressure portions 54, 61 of the cover 7. This also contributes to the increase of the contact pressure.

As shown in FIGS. 9A and 9B, when the cover 7 is slidably moved rearwardly, the front end 44 of the fixing piece 38 of the first contact 19 is adapted to slide on the guide portion 43 of the rear edge portion 40 of the cover 7. Thus, the fixing piece 38 is adapted for the positive prevention of an upward dislocation of the rear edge portion 40 of the cover 7 in the close position. This ensures a high contact pressure against the connection member 2.

It is to be noted that the invention should not be limited to the foregoing embodiment. For instance, although the above embodiment is arranged such that all of the plural first contacts 19 have the front ends 44 of the fixing pieces 38 thereof extended beyond the rear edge portion 40 of the cover 7, all the front ends 44 should not be extended this way. At least some of the front ends 44 of the fixing pieces 38 may be extended beyond the rear edge portion 40 of the cover 7.

Alternatively, all of the first and second contacts 19, 20 may have the front ends 44, 51 of the fixing pieces 38, 49 thereof extended beyond the rear edge portion 40 of the cover 7 so as to prevent the upward dislocation of the rear edge portion 40 of the cover 7.

In the foregoing embodiment, the guiding support portions 14 and the lock portions 15 are formed at the metallic reinforcement plate 13 but should not necessarily be formed this way. For instance, there may be employed a synthetic-resin reinforcement plate which may be formed with the guiding support portions and the lock portions. Alternatively, the guiding support portions and the lock portions may be formed at the housing body 4.

The invention is also applicable to the connection of a connection member for FFC (Flexible Flat Cable), PCB (Printed Circuit Board) and the like, in stead of that for FPC (Flexible Printed Circuit). The invention is further applicable to a vertical-type electrical connector wherein the connection member is not laterally inserted but inserted from above.

Although the invention has been described in detail with reference to the specific embodiment thereof, changes and modifications thereof as well as equivalents thereto are apparent to those skilled in the art who have fully understood the content hereof. Therefore, it is to be construed that the invention fall within the scope defined by the appended claims and equivalents thereto.

What is claimed is:

1. An electrical connector for connection of a flat-type connection member comprising:

an insulative housing having an opening and a plurality of longitudinally-extending contacts facing into the opening;

a synthetic-resin cover pivotally movable about a predetermined pivotal axis and slidable in a longitudinal direction relative to the housing for moving between an open position and a close position to press the connection member against the contacts;

a pair support shafts disposed at a pair of sides of the cover, respectively, and extended along the pivotal axis;

a pair of engagement portions disposed at a pair of sides of the cover, respectively;

a pair of support portions disposed at the housing for supporting the pair of support shafts respectively;

a pair of lock portions disposed at the housing and disengageably engaging the pair of engagement portions for locking the cover in the close position; and a metal plate substantially embedded in the cover for reinforcing the cover, wherein the metal plate is integrally constructed with the pair of support shafts and the pair of engagement portions.

2. The electrical connector as claimed in claim 1, wherein the metal plate is formed of a sheet metal.

3. The electrical connector as claimed in claim 1, further comprising a pair of metallic reinforcements fixed to a pair of sides of the housing, respectively, the pair of metallic reinforcements provided with the pair of support portions.

4. The electrical connector as claimed in claim 1, further comprising a pair of metallic reinforcements fixed to a pair of sides of the housing, respectively, the pair of metallic reinforcements provided with the pair of lock portions.

5. The electrical connector as claimed in claim 1, further comprising a pair of metallic reinforcements fixed to a pair of sides of the housing, respectively, the pair of metallic reinforcements provided with the pair of support portions and the pair of lock portions.

6. The electrical connector as claimed in claim 1, wherein the pair of support shafts have a circular shape in section.

7. The electrical connector as claimed in claim 1, wherein the pair of engagement portions have a circular shape in section.

8. The electrical connector as claimed in claim 1, wherein the pair of support shafts and the pair of engagement portions have a circular shape in section.

9. The electrical connector as claimed in claim 1, wherein the metal plate comprises a body portion embedded in the cover in the resin forming process of the cover; and two pairs of projections, a respective pair of projections extended from a pair of sides of the body portion.

10. The electrical connector as claimed in claim 9, wherein the respective pair of projections of the metal plate include a pair of exposed portions exposed from corresponding sides of the cover, respectively, the respective pair of exposed portions provided with corresponding support shafts or engagement portions, respectively.

* * * * *